US006540561B1

(12) United States Patent
Masumoto

(10) Patent No.: US 6,540,561 B1
(45) Date of Patent: Apr. 1, 2003

(54) LOCKING MECHANISM FOR SECURELY PREVENTING DISCONNECTION BETWEEN A PLUG AND A RECEPTACLE

(75) Inventor: Toshio Masumoto, Musashimurayama (JP)

(73) Assignee: Japan Aviation Electronic Industry, Ltd., Tokyo (JP)

( * ) Notice: Subject to any disclaimer, the term of this patent is extended or adjusted under 35 U.S.C. 154(b) by 0 days.

(21) Appl. No.: 09/634,976

(22) Filed: Aug. 9, 2000

(30) Foreign Application Priority Data

Oct. 25, 1999 (JP) ..... 11-301951

(51) Int. Cl.[7] ..... H01R 13/60
(52) U.S. Cl. ..... 439/660
(58) Field of Search ..... 439/74, 848, 889, 439/660

(56) References Cited

U.S. PATENT DOCUMENTS 1,912,147 A * 5/1933 Kaefer ..... 439/848
4,274,700 A * 6/1981 Keglewtsch et al. ..... 439/682
4,755,143 A * 7/1988 Enomoto et al. ..... 439/74
4,795,362 A * 1/1989 Vonder et al. ..... 439/377
5,025,121 A * 6/1991 Allen et al. ..... 439/848
5,931,689 A * 8/1999 Patel ..... 439/74

FOREIGN PATENT DOCUMENTS

| | | | | |
|---|---|---|---|---|
| DE | 3110609 A1 | * | 3/1981 | |
| EP | 0450770 A | | 10/1991 | |
| EP | 0795929 A | | 9/1997 | |
| FR | 2636476 A | | 3/1990 | |
| JP | 2676063 | | 7/1997 | ..... H01R/23/68 |

* cited by examiner

*Primary Examiner*—Brian Sircus
*Assistant Examiner*—Phuong Dinh
(74) *Attorney, Agent, or Firm*—Michael, Best & Friedrich, LLC

(57) ABSTRACT

In a plug connector (1) for being connected to a receptacle connector (2) in a first direction, a plug contact (13) is held by a plug housing (11) and has a principal surface extending along the first direction. The plug contact is formed with a concave portion recessed from the principal surface in a second direction perpendicular to the first direction. A wall is remained between the principal surface and the concave portion. In the receptacle connector (2), a receptacle housing (21) holds a receptacle contact (23) for coming in contact with the plug contact in the second direction. The receptacle contact is formed with a projection (23*d*) which is positioned inside the concave portion when the plug connector is connected to the receptacle connector.

1 Claim, 7 Drawing Sheets

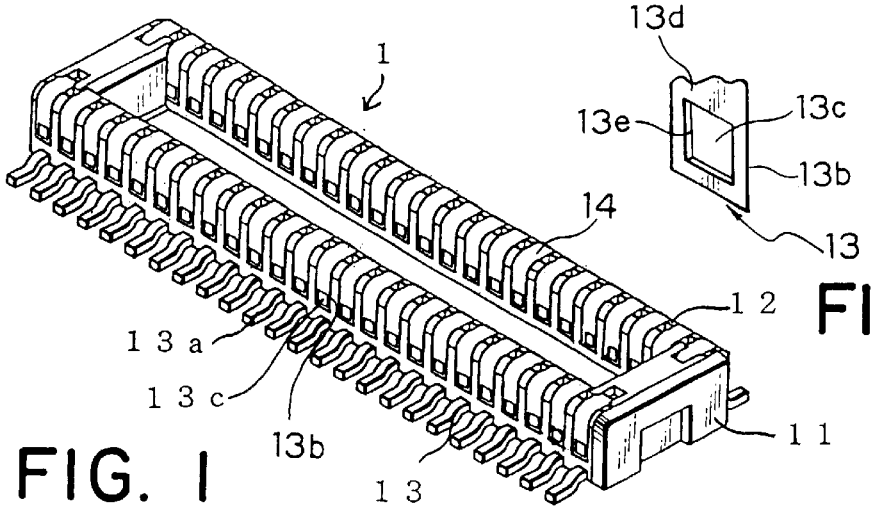
FIG. 1
FIG. 2
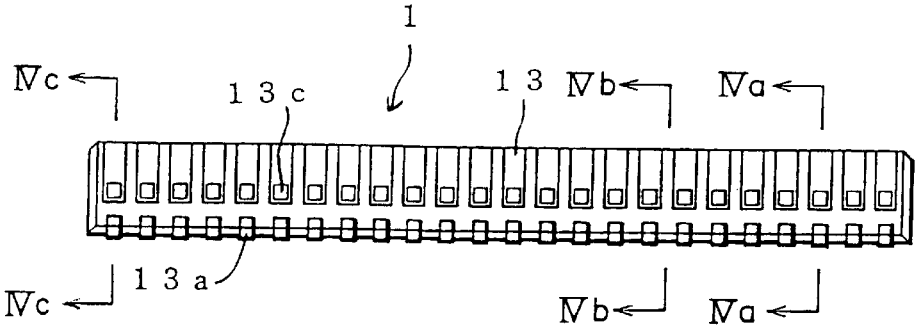
FIG. 3

LOCKING MECHANISM FOR SECURELY PREVENTING DISCONNECTION BETWEEN A PLUG AND A RECEPTACLE

BACKGROUND OF THE INVENTION

The present invention relates to an electrical connector and, more particularly, to an electrical connector for electrically connecting printed circuit boards or the like.

An electrical connector is used for electrically connecting printed circuit boards or electrically connecting a printed circuit board and an electrical cable such as a flexible printed circuit (hereinafter referred to as "FPC"). Such an electrical connector normally includes a plug connector and a receptacle connector to be connected to the plug connector.

To prevent disconnection between the plug connector and the receptacle connector, for example, disclosed in Japanese Patent No. 2676063 is a locking mechanism for engaging contacts of the plug connector with contacts of the receptacle connector. Since the contacts are normally made of material such as metal that is hard to be worn against the rubbing, the deterioration of the locking mechanism as a result of repeated insertion of the plug connector into the receptacle connector is extremely low.

However, the locking mechanism has the following problems.

When the connector is small and thin and has densely-arranged contacts, a mechanism for holding the contacts in a housing is complex so that it is impossible to provide large force for holding the contacts in the housing. Therefore, there are possibilities that the contacts come off the housing when the plug connector is removed from the receptacle connector and that the dimensional accuracy at contact portions of the contacts and soldered portions of the contacts becomes worse.

In case that the housing and the contacts are integrally formed, an outer surface of a mold may rub the contact surfaces of the contacts when the mold is released. The contact surfaces of the contacts may be scratched so that surface treatment including gold plating on the contact surfaces and/or sealing provided for treating the gold plating is affected. In this case, it is difficult to provide suitable electrical contact.

SUMMARY OF THE INVENTION

It is therefore an object of the present invention to provide an electrical connector which has a locking mechanism for securely preventing disconnection between a plug connector and a receptacle connector.

It is another object of the present invention to provide an electrical connector of the type described, which can provide large force of holding contacts to a housing and is suitable for an integral molding of the housing and the contacts.

Other objects of the present invention will become clear as the description proceeds.

According to an aspect of the present invention, there is provided an electrical connector comprising a plug connector and a receptacle connector which are adapted to be connected to each other in a first direction, the plug connector comprising a plug housing and a plug contact held by the plug housing, the receptacle connector comprising a receptacle housing and a receptacle contact held by the a receptacle housing for coming in contact with the plug contact when the plug connector is connected to the receptacle connector, one of the plug contact and the receptacle contact having a principal surface extending along the first direction, a concave portion recessed from the principal surface in a second direction perpendicular to the first direction, and a wall between the principal surface and the concave portion, another of the plug contact and the receptacle contact having a projection which is positioned inside the concave portion when the plug connector is connected to the receptacle connector.

According to another aspect of the present invention, there is provided a plug connector for being connected to a receptacle connector in a first direction, the plug connector comprising a plug housing and a plurality of plug contacts held by the plug housing for coming in contact with the receptacle connector, each of the plug contacts having a principal surface extending along the first direction, a concave portion recessed from the principal surface in a second direction perpendicular to the first direction, and a wall between the principal surface and the concave portion.

According to still another aspect of the present invention, there is provided a receptacle connector for being connected to the above-mentioned plug connector, the receptacle connector comprising a receptacle housing and a plurality of receptacle contacts held by the receptacle housing for coming in contact with the first-mentioned contact portion in the second direction, each of the receptacle contacts having a projection which is positioned inside the concave portion when the plug connector is connected to the receptacle connector.

BRIEF DESCRIPTION OF THE DRAWINGS

FIG. 1 is a perspective view showing a plug connector included in an electrical connector according to a first embodiment of the present invention;

FIG. 2 is an enlarged view of a main part of a contact included in the plug connector of FIG. 1;

FIG. 3 is a front view of the plug connector shown in FIG. 1;

DESCRIPTION OF THE PREFERRED EMBODIMENTS

Figure 4A:
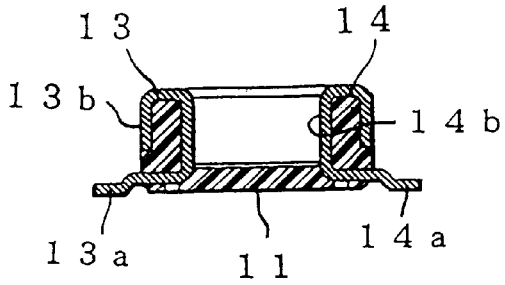
FIG. 4A is a sectional view taken along a line IVa—IVa of FIG. 3.
Figure 4B:
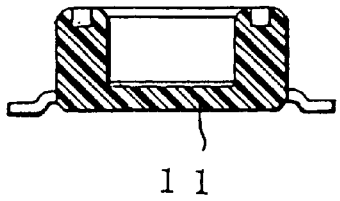
FIG. 4B is a sectional view taken along a line IVb—IVb of FIG. 3.
Figure 4C:
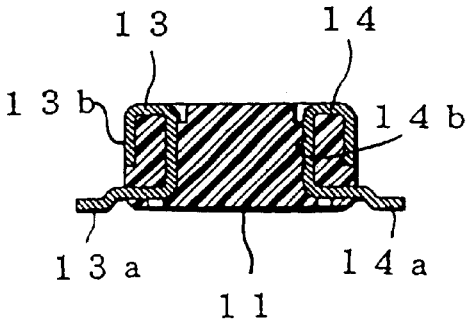
FIG. 4C is a sectional view taken along a line IVc—IVc of FIG. 3.
Figure 5:
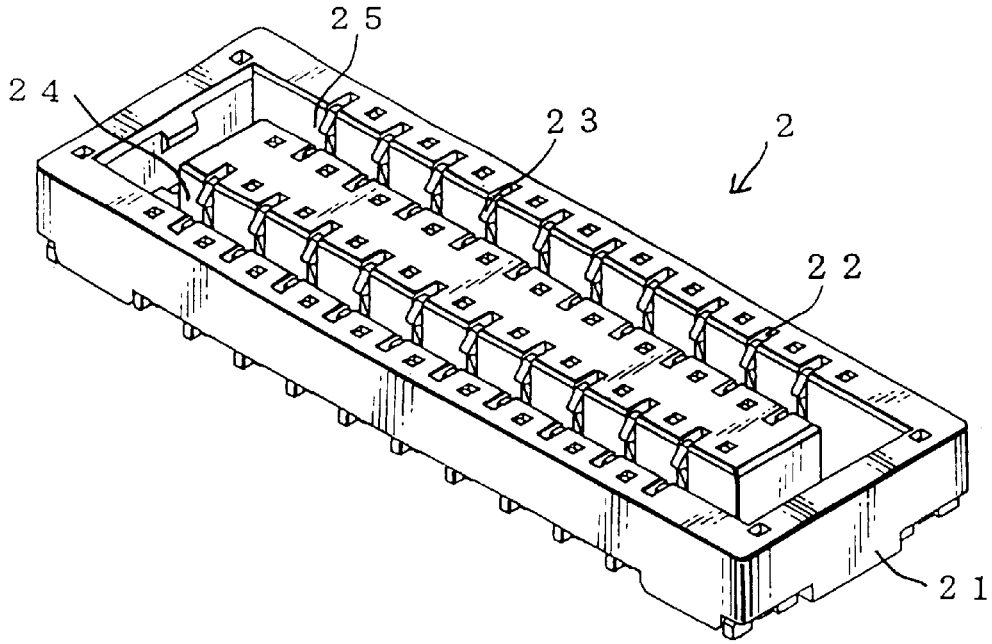
FIG. 5 is a perspective view showing a receptacle connector included in the electrical connector according to the first embodiment of the present invention.
Figure 6:
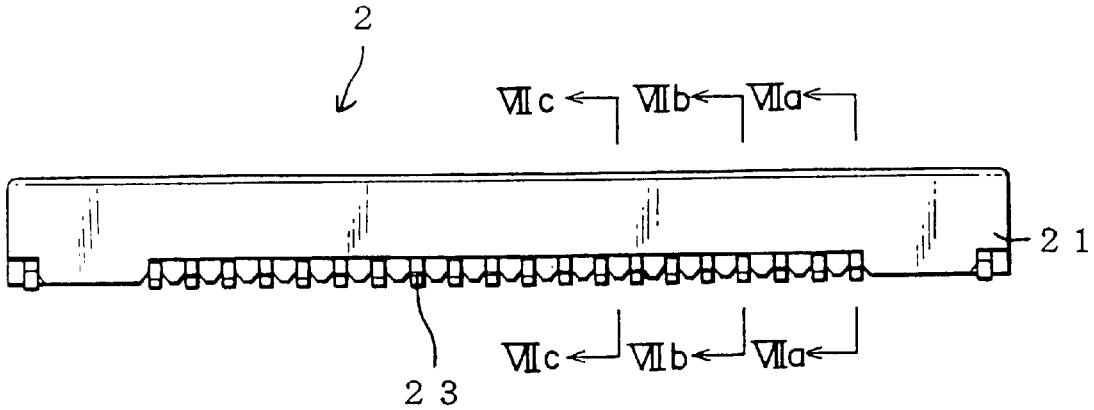
FIG. 6 is a front view of the receptacle connector shown in FIG. 5.
Figure 7A:
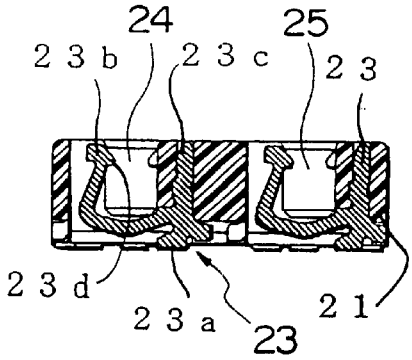
FIG. 7A is a sectional view taken along a line VIIa—VIIa of FIG. 6.
Figure 7B:
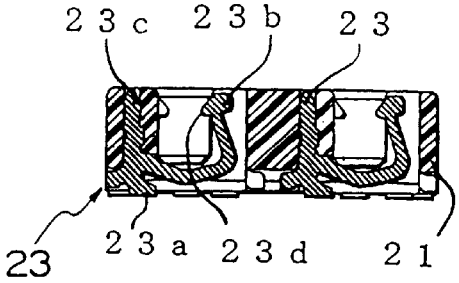
FIG. 7B is a sectional view taken along a line VIIb—VIIb of FIG. 6.
Figure 7C:
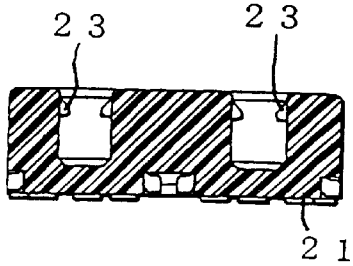
FIG. 7C is a sectional view taken along a line VIIc—VIIc of FIG. 6.

With reference to FIGS. 1 through 9, description will be made as regards an electrical connector according to a first embodiment of the present invention.

The electrical connector includes a plug connector 1 and a receptacle connector 2 which are connected to or disconnected from each other in a first direction. The following description will be made assuming that the plug connector 1 and the receptacle connector 2 are arranged on a circuit board, but it should be understood that the present invention is not limited thereto.

Referring to FIG. 1 through FIG. 4C, the plug connector 1 includes a plug housing 11 made of an insulating material such as synthetic resin and a plurality of plug contacts 13 and 14 parts of which are fixed and held in a plurality of parallel grooves 12 formed in the housing 11. The contacts 13 are aligned in parallel on the left side of the housing 11 in FIGS. 4A–4C. The contacts 14 are aligned in parallel on the right side of the housing 11 in FIG. 1.

Each of the contacts 13 has a board connecting portion 13*a* connected by soldering or the like to an electrical circuit on the circuit board (not shown) on which the plug connector 1 is arranged and a contact portion 13*b* which comes in contact with a corresponding contact of the receptacle connector 2 when the plug connector 1 is connected to the receptacle connector 2. Each of the contacts 14 has a board connecting portion 14*a* and a contact portion 14*b* which are similar to the board connecting portion 13*a* and the contact portion 13*b*, respectively. Though the contacts 13 have the same configuration and the same size as those of the contacts 14, the configuration of the contacts 13 may be different from that of the contacts 14, for example, in that concave portions are formed in different positions.

As particularly shown in FIG. 2, the description will be directed to one of the plug contacts 13 and 14. In the plug contact 13, the contact portion 13*b* has a principal flat surface 13*d* formed with a concave portion 13*c* having a surrounding wall 13*e*. More particularly, the contact portion 13*b* has the principal flat surface 13*d*, the concave portion 13*c* recessed from the principal flat surface 13*d* in a second direction perpendicular to the first direction, and the wall 13*e* surrounding the concave portion 13*c* between the principal flat surface 13*d* and the concave portion 13*c*. The concave portion 13*c* can be formed for example by coining a relating portion of the plug contact 13. Though the concave portion 13*c* are quadrate in the illustrative example, it is not limited thereto and may be circular or elliptical in form. It is to be noted that the other plug contact 14*b* has structure similar to that of the above-mentioned plug contact 13.

Referring to FIGS. 5 through 7C, the receptacle connector 2 includes a receptacle housing 21 made of an insulating material such as synthetic resin and a plurality of receptacle contacts 23 parts of which are fixed and held in a plurality of parallel grooves 22 formed in the housing 21. The receptacle connector 2 is provided with spaces 24 and 25 for fitting the plug connector 1 therein.

Each of the receptacle contacts 23 has a board connecting portion 23*a* connected by soldering or the like to an electrical circuit on a circuit board (not shown) on which the receptacle connector 2 is arranged, a contact portion 23*b* which comes in elastic contact with a corresponding contact of the plug connector 1 when the plug connector 1 is connected to the receptacle connector 2, and a press fitting portion 23*c* inserted into the housing 21. The contact portion 23*b* is formed at one end thereof with a projection 23*d* protruding in the second direction.

The contact portion 23*b* has substantially a C-like configuration extending from the board connecting portion 23*a* and the press fitting portion 23*c*. Because of this configuration, the contact portion 23*b* has elasticity (like a spring) in the second direction or the right-left direction of FIG. 7A.

Figure 8:
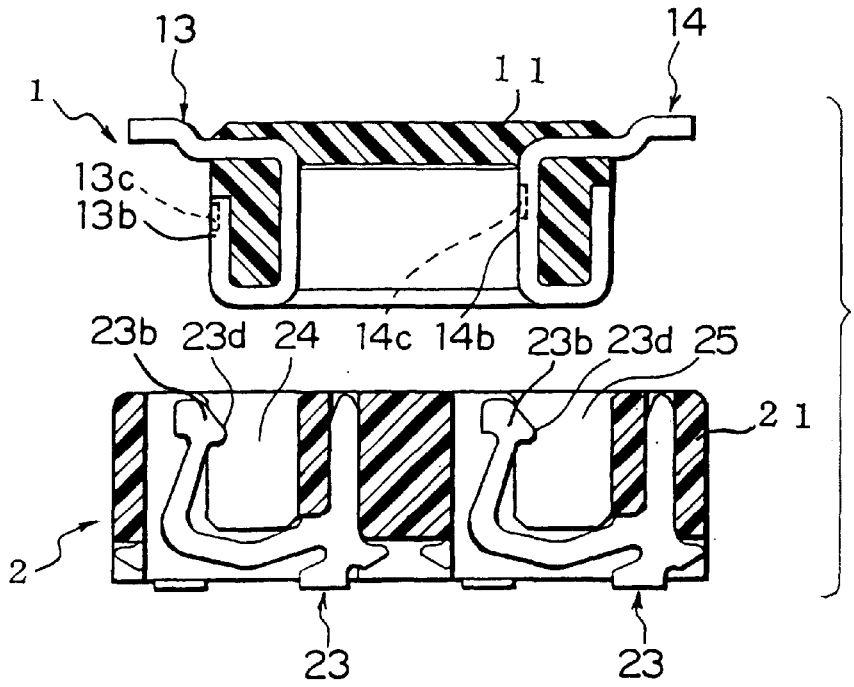
FIG. 8 is an explanatory view showing the plug connector of FIG. 1 and the receptacle connector of FIG. 5 before the connection.
Figure 9:
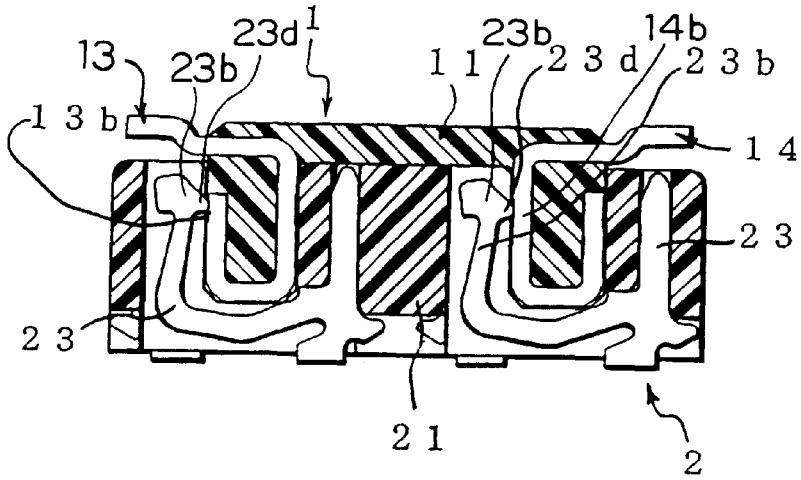
FIG. 9 is an explanatory view showing the plug connector of FIG. 1 and the receptacle connector of FIG. 5 connected to each other.

Hereinafter, the description will now be made as regard to a case in which the plug connector 1 and the receptacle connector 2 are connected to each other. In the case, the plug connector 1 is positioned above the receptacle connector 2 to face the plug connector 1 with the spaces 24 and 25 of the receptacle connector 2 as shown in FIG. 8. Then, the plug connector 1 is fitted into the spaces 24 and 25. As a result, the plug connector 1 and the receptacle connector 2 are connected to each other so that the contact portions 13*b* and 14*b* of the contacts 13 and 14 of the plug connector 1 come in contact with the contact portions 23*b* of the contacts 23 of the receptacle connector 2 as shown in FIG. 9.

Since the contact portions 23*b* of the contacts 23 are elastic as mentioned above, the contact portions 13*b* and 14*b* are in elastic contact with the contact portions 23. The projection 23*d* of the contact portion 23*b* of the each contact 23 is inserted in the concave portions 13*c* and 14*c* formed in the contact portion 13*b* and 14*b* of the each contact 13, 14. This elastic press fitting of the projections 23*d* with the concave portions 13*c* and 14*c* composes or forms a locking structure or mechanism for securely preventing the disconnection between the plug connector 1 and the receptacle connector 2.

Figure 10:
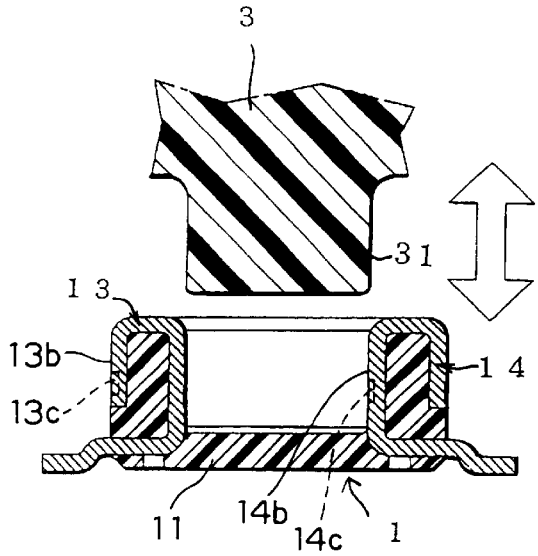
FIG. 10 is an explanatory view showing the state that the plug connector of FIG. 1 is integrally formed.
Figure 11:
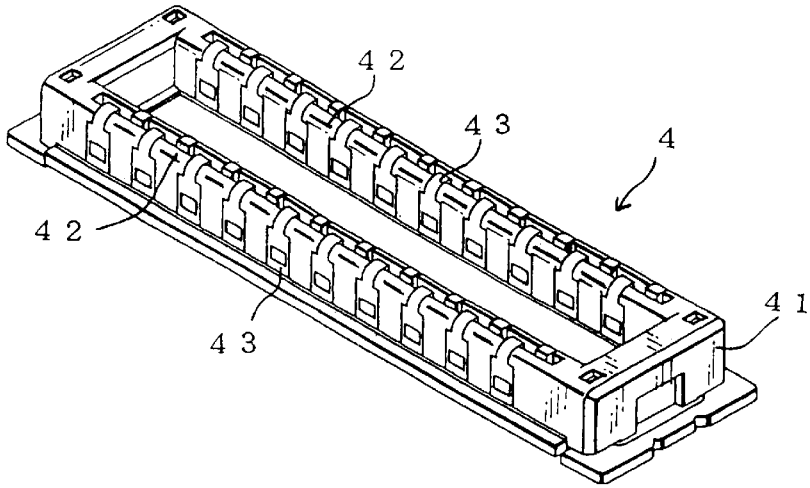
FIG. 11 is a perspective view showing a plug connector included in an electrical connector according to a second embodiment of the present invention.
Figure 12:
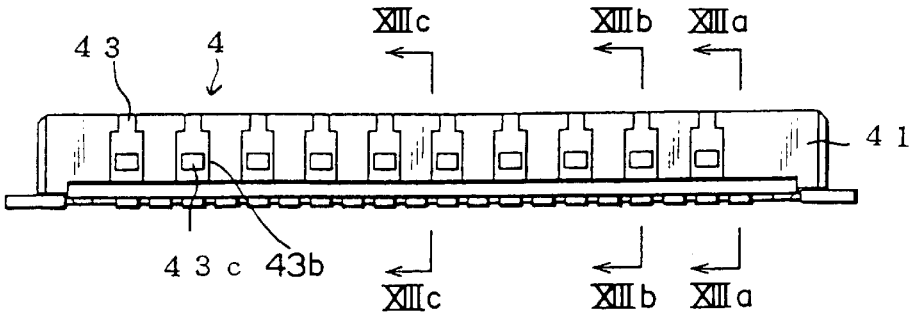
FIG. 12 is a front view of the plug connector of FIG. 11.
Figure 13A:
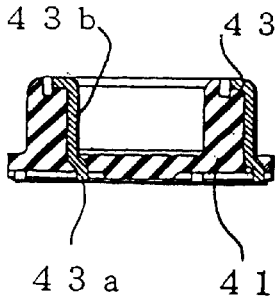
FIG. 13A is a sectional view taken along a line XIIIa—XIIIa of FIG. 12.
Figure 13B:
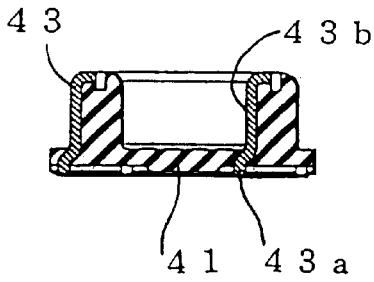
FIG. 13B is a sectional view taken along a line XIIIb—XIIIb of FIG. 12.
Figure 13C:
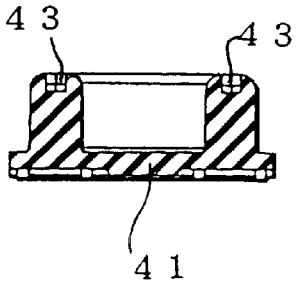
FIG. 13C is a sectional view taken along a line XIIIc—XIIIc of FIG. 12.

FIG. 10 shows one of steps for making the plug connector 1 by integral molding of the housing 11 and the contacts 13 and 14 and, more particularly, shows the state that a mold 3 is released after the integral molding. Even when an outer surface 31 of the mold 3 rubs the outer surface of the contact 14 during the release of the mold, the concave portion 14*c* which is an actual contact portion of the contact portion 14*b* is never scratched by the outer surface 31 because the concave portion 14*c* is positioned little back from other portion of the contact portion 14*b*.

With reference to FIGS. 11 through 13C, the description will be made as regards an electrical connector according to a second embodiment of the present invention.

The electrical connector includes a plug connector 4. The plug connector 4 includes a housing 41 made of an insulating material such as synthetic resin and a plurality of contacts 43 which are fixed and held by contact holding portions 42 disposed on the both sides of the housing 41 and are aligned in parallel. The contacts 43 are aligned on the right and left contact holding portions 42 alternately i.e. in a zigzag configuration.

Each of the contacts 43 has a board connecting portion 43*a* connected by soldering or the like to an electrical circuit on the circuit board (not shown) on which the plug connector 4 is arranged and a contact portion 43*b* which comes in contact with a corresponding contact of a receptacle connector (not shown) when the plug connector 4 is connected to the receptacle connector. The contact portions 43*b* have flat surfaces each of which is formed with a concave portion 43*c* having surrounding walls.

The plug connector 4 is connected to the receptacle connector which is similar to that described with reference to FIGS. 1–9. In this state, the contact portions 43*b* are in elastic contact with corresponding contact portions of the contacts of the receptacle connector and corresponding projections of the contacts of the receptacle connector are elastically press fitted in the concave portions 43*c*, thereby composing a locking structure or a locking mechanism for preventing the disconnection between the plug connector 4 and the receptacle connector.

In the above-mentioned electrical connector, contact portions of plug contacts or receptacle contacts are composed of concave portions, each having surrounding walls, formed in flat surfaces of either the plug contacts or the receptacle contacts and projections to be positioned inside the concave portions when the connectors are connected to each other. The concave portions and the projections serve as a locking mechanism for preventing the disconnection between the plug connector and the receptacle connector.

Since the concave portions having the surrounding walls are formed in the flat surface of the contact portions, resin never enters into the concave portions during the integral molding so that the housing and the contacts of the connector are integrally formed. Further, since the concave portions are formed to have surrounding walls, i.e., formed by denting a portion of the flat surface, the concave portions never be scratched by an outer surface of a mold when the mold is released after the integral molding so that gold plating on the contact surfaces and/or sealing provided for treating the gold plating is not affected, thereby providing suitable electrical contact.

What is claimed is:

1. A plug connector for being connected to a receptacle connector responsive to motion in a first direction, said plug connector comprising:

an insulating plug housing with a plurality of plug contacts molded in said plug housing, said plurality of plug contacts including:

a first set of plug contacts each having a first principal surface extending along said first direction, a U-bend and a second principal surface, parallel to the first principal surface and a wall between the first principal surface and said second principal surface, said second principal surface having a concave portion recessed from the second principal surface;

a second set of plug contacts each having a first principal surface extending along said first direction, a U-bend and a second principal surface, parallel to the first principal surface and a wall between the first principal surface and said second principal surface, said first principal surface having a concave portion recessed from the second principal surface; and a receptacle having two conductive projections, each of said projections engaging an individually associated one of said concave portions for making electrical contact with said concave portions in order to complete an electrical circuit and to mechanically interlock said plug and receptacle.

* * * * *